United States Patent [19]

Luppi et al.

[11] Patent Number: 4,774,821

[45] Date of Patent: Oct. 4, 1988

[54] DRY CLEANING MACHINE

[76] Inventors: Giorgio Luppi; Maria L. Luppi, both of 34, Via 10 Maggio, I-40011 Anzola Emilia, Bologna, Italy

[21] Appl. No.: 41,217

[22] Filed: Apr. 22, 1987

[30] Foreign Application Priority Data

Nov. 26, 1986 [CA] Canada ..... 523843

[51] Int. Cl.[4] ..... D06F 43/08

[52] U.S. Cl. ..... 68/18 C; 68/18 R

[58] Field of Search ..... 68/18 R, 18 C

[56] References Cited

U.S. PATENT DOCUMENTS

| | | | |
|---|---|---|---|
| 2,114,776 | 4/1938 | Davis | 68/18 R |
| 3,110,544 | 11/1963 | Moulthrop | 68/18 R |
| 3,122,908 | 3/1964 | Stanulis et al. | 68/18 R |
| 3,206,950 | 9/1965 | Xeros | 68/18 R |
| 3,391,550 | 7/1968 | Williams | 68/18 C |
| 3,426,555 | 2/1969 | McCutcheon | 68/18 C |
| 3,610,002 | 10/1971 | Carpigiani | 68/18 C |

FOREIGN PATENT DOCUMENTS

| | | | |
|---|---|---|---|
| 1408263 | 10/1975 | United Kingdom | 68/18 C |

OTHER PUBLICATIONS

Union Catalogue-Dry Cleaning Apparatus Limpia 75, 85, 95, 110.

Donini Catalogue-Dry Cleaning Apparatus D25 and D35.

*Primary Examiner*—Philip R. Coe
*Assistant Examiner*—S. Gerrity
*Attorney, Agent, or Firm*—King and Schickli

[57] ABSTRACT

The dry cleaning apparatus includes a heat and cold generating unit for heating a heating liquid such as diathermic oil and cooling a cooling liquid such as anti-freeze. A heating liquid circuit operates during a dry cleaning solvent regeneration phase to evaporate the solvent following clothes cleaning. A cooling liquid circuit operates during this phase to condense the solvent following evaporation. During a subsequent cleaning phase the heating liquid circuit heats the air circulating through a barrel including the clothes being cleaned. Simultaneously, the cooling liquid circuit cools a heat exchanger provided in a duct for the circulating air so as to condense solvent from the heated circulating air and return it to the barrel. The heating liquid circuit is actually split with a heating resistor provided in one subcircuit. Radiators in the two subcircuits are heated to different temperatures and a valve controls circulating air flow through these two radiators during both the cleaning and drying phases thereby allowing controlled temperature adjustment.

6 Claims, 3 Drawing Sheets

DRY CLEANING MACHINE

BACKGROUND OF THE INVENTION

The present invention relates to an improvement with the purpose to obtain a better thermal efficiency, an environment deodorization and the regeneration of the chlorine-ethylene in a dry cleaning machine for clothes or fabrics of various types.

SUMMARY OF THE INVENTION

The invention as disclosed hereunder and illustrated in FIGS. 1, 2, 3, 3A, 4 and 4A covers a dry cleaning machine wherein the means for condensing the vapours of chlorine-ethylene, or other similar solvent, receive circulating anti-freeze liquid. This liquid is cooled inside an original unit prior to circulating through the condensor. The unit also includes a compressor for heating this anti-freeze liquid which is then circulated to warm diathermic oil for evaporating chlorine-ethylene during its regeneration phase and to heat the air during cleaning and drying phases. As a consequence of having introduced the above heat and cold generating unit, illustrated in FIG. 1, it has been possible to eliminate the utilisation of the cooling water and of electric resistors, so creating an original circuit allowing development of a continuous operating cycle, a better adjustment of the air temperature during cleaning, as well as to depollute the mud resulting from chlorine-ethylene regeneration.

DETAILED DESCRIPTION OF THE INVENTION

Figure 1:
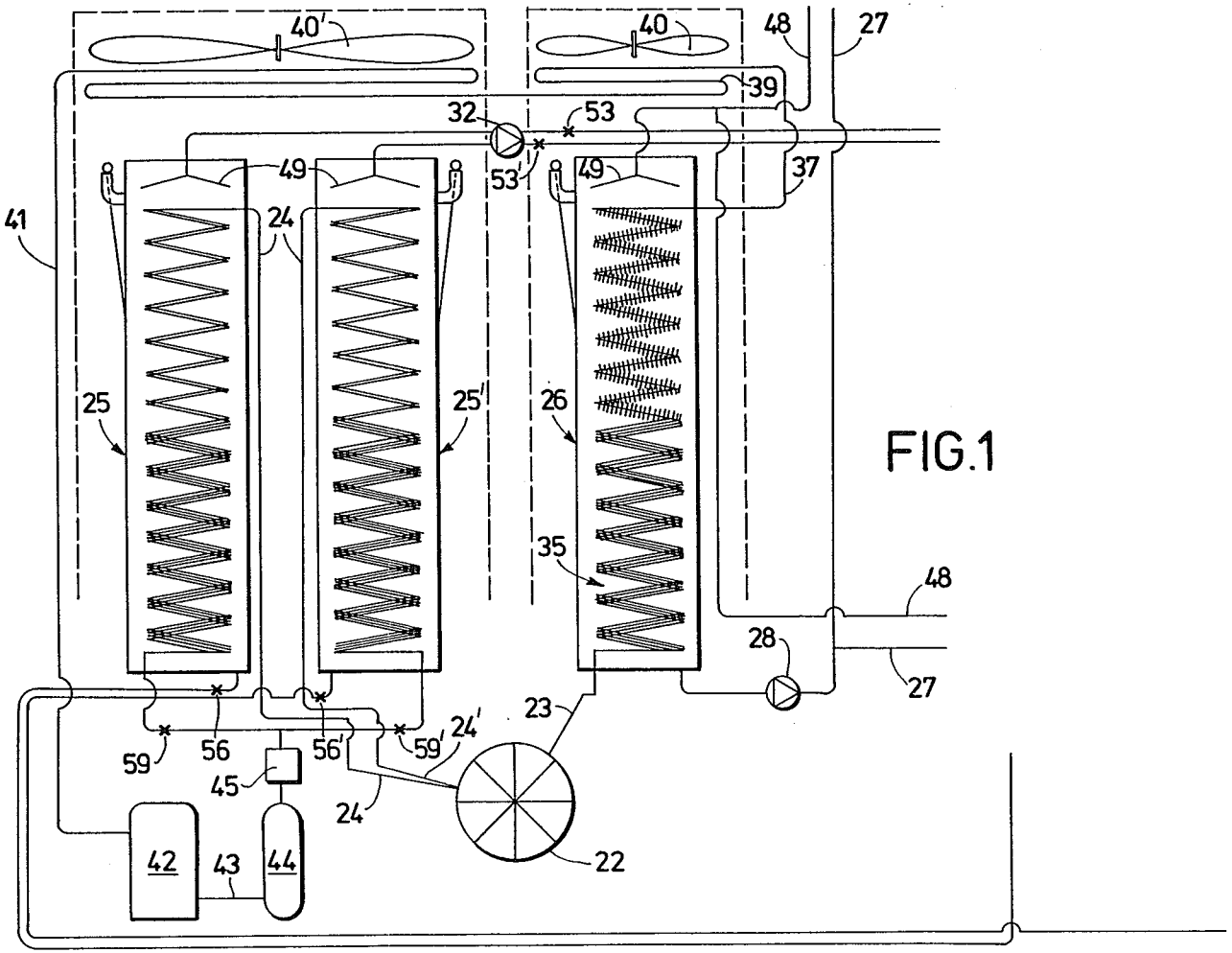
FIG. 1 is a schematical representation of the heat and cold generating unit of the dry cleaning apparatus of the present invention.

FIG. 1 shows the original heat and cold generating unit, consisting of two cooling columns 25 and 25' and of a warming column 26, each column containing two types of pipe coils acting as heat exchangers. A first type is inserted in the bottom of the columns, where two of them 25, 25' are continuously fully immersed in the cooling anti-freeze liquid and the third one 26 in the heating dyathermic oil. The second type is placed in the top of the column, wherein the liquid drops downwards and laps the pipe coil when such column is included in the circuit. The heat and cold generating unit illustrated in FIG. 1 consists of a refrigerating compressor unit 22 which pressurizes a heat exchange medium such as sold under the trademark Freon sending it to the pipe coil 35, inside the column 26, through the pressurized gas delivery duct 23. The pipe coil 35 rises, starting from the bottom of the column 26, in a series of tight spirals formed by a non-finned copper tube, filling almost completely the bottom of the column 26 thus, in the bottom portion of the column 26, constantly filled by dyathermic oil, the coil 35 takes a volume lower than about half of the volume generated by the column 26. The second section of the pipe coil 35 consists of a copper finned tube whose function is, besides diffusing the heat over a wider dispersing surface, also to keep the dyathermic oil, falling downwards, in contact for a longer time with the surface acting as a dispersant. As soon as the Freon, already cooled, has reached the top of the column 26 wherein is provided the distributing shaped plate 49 for dyathermic oil inlet, it enters the radiator 39 through the outlet pipe 37. There the Freon disperses in the ambient circulating air the remaining calories of heat. More specifically a first fan 40 sucks the ambient air from the top side forcing it downwards through the radiator 39 causing it to subsequently lap the column 26 from the outside. A second fan 40', on the contrary, sucks from the bottom the air which previously lapped the two columns 25 and 25', forcing it upwards through the radiator 39.

The pressurized Freon gas, brought to the ambient temperature, then circulates down through the pipe 41 so entering into the first plenum chamber (decanter) 42 and from here, through the pipe 43, into the second plenum chamber (decanter) 44, then reaching the expansion unit 45 wherein it is expanded and thereby cooled.

The liquid Freon, past the expansion unit 45, is split up in two pipes having the same rate of flow, which enter into the columns 25 and 25'. Immediately past the inlet, each one of the two pipes is splitting in four pipes having a section identical to the inlet one, so that the rate of flow which had already been halved past the expansion unit 45 is further reduced in each duct. The four pipes, which are smooth, rise in the shape of a pipe coil inside each of the two columns 25 and 25' and in this bottom section they are continuously immersed in the anti-freeze liquid. Thus there is a great transfer of cold from the Freon contained in the four pipes, to the anti-freeze liquid in which they are immersed this occurs because of the low circulating speed of the liquid Freon which causes the outside temperature of the coils to be almost the same as the Freon and the contact surface of the coils with the anti-freeze liquid is the maximum allowed by the volume of column.

Figure 4:
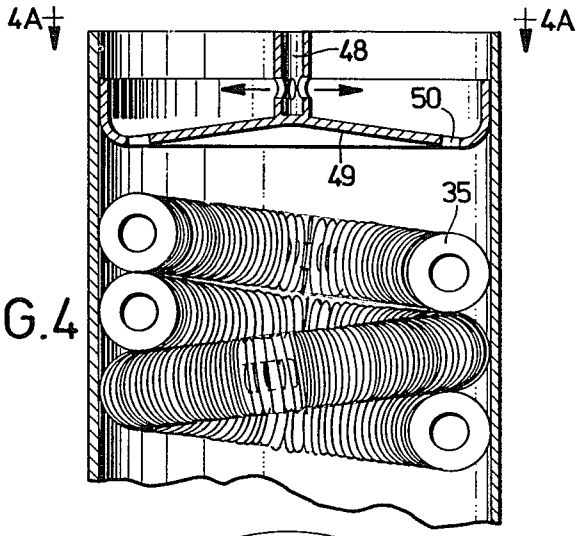
FIG. 4 is a cross sectional view and FIG. 4*a* a related top plan view showing a fluid distribution plate positioned in a warming column of the present invention.
Figure 4A:
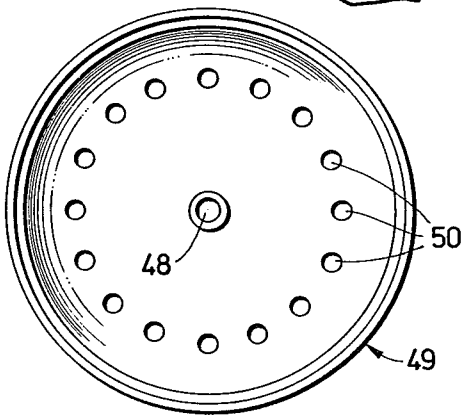

The four tubes rise in the shape of a pipe coil inside the column up to reaching the level of the anti-freeze liquid contained therein. From here the four pipes are connected two by two, in two pipes having a doubled section, also rising in the shape of a pipe coil up to the top of the column 25, 25' wherein the distributing shaped plate 49 is provided. The plate 49 causes the anti-freeze liquid which is entering the column 25, 25', to drop onto the two spiral-rising pipes, as shown in FIG. 4. In this way the Freon, after having yielded most of its refrigeration units in the first portion of the pipe coil, rises in a lower density condition due to its higher temperature, to the second portion of the column, meeting therein in counter-current the anti-freeze liquid flowing from the top and lapping the outside surface of the two pipes with a thin layer.

Before coming out from the respective columns, the two pipes join in one only, having a higher section, so from the column 25 comes out and descends the pipe 24 and column 25' comes and descends the return pipe 24'; these pipes then joining in one pipe when entering into the refrigerating compressor unit 22.

In FIG. 4 is illustrated a detail of the column 26, namely its top portion, wherein the pipe coil 35, rises from the bottom of the column to a distributing shaped plate 49, on which the dyathermic oil is delivered by the return pipe 48. The oil flows out through the holes in the return pipe 48, and is distributed on the shaped plate 49 wherein the oil meets a number of holes 50 allowing it to drop on the ring formed by the last turn of the finned pipe.

From here the dyathermic oil flows in a thin layer along the coil from turn to turn until it reaches the level of the oil in the column. Its level inside the column remains unaltered because the same quantity entering through the return pipe 48 is sucked by the pump 28 putting it in circulation.

This unit produces sufficient heat to regenerate the chlorine-ethylene and, in the following phase, to heat the cleaning air. Simultaneously, this unit produces sufficient refrigeration units, both for the quick starting and for the life of the chlorine-ethylene regeneration and following cleaning phases.

It has to be noted that, while the heating of dyathermic oil takes place inside a single column 26, the cooling of the anti-freeze liquid is performed inside two columns 25 and 25', the former connected to the chlorine-ethylene regeneration circuit, the latter to the cleaning circuit.

This allows the delivery of the anti-freeze liquid at the lowest temperature when it starts circulating in the circuit to which such column is connected, and this with the purpose to be able to start that phase of the circuit quickly.

As the dry cleaning machine starts to operate, the chlorine-ethylene regeneration phase is provided to be carried out. In consequence of this fact it is the cold column 25 the one destined to this phase, which has to start to operate first. In order that it reaches the lowest foreseen temperature in the shortest possible time, the central control unit operates the two solenoid valves 59 and 59', by opening the one placed in the circuit of the column provided for chlorine-ethylene regeneration—solenoid valve 59—and closing the other one 59'. Once the foreseen temperature is reached, the central control unit commands the starting of the chlorine-ethylere regeneration phase by opening simultaneously the solenoid valve 59' which, allowing the liquid Freon to rise also inside the second column, sets this one for the following cleaning phase. In this way, at the starting, the liquid Freon is circulating inside one column only, wherein the anti-freeze liquid is standstill, so bringing it in a shorter time to the lowest foreseen temperature. Later the liquid Freon is circulating simultaneously inside both columns 25 and 25' so that, when the anti-freeze liquid is circulating in 25 it is standing in the bottom of the column 25', wherein the temperature of the two liquids—the Freon and the standing anti-freeze—is tending to equalize.

In the top of column 25', during this phase, there is a lower transfer of regrigeration units because the anti-freeze liquid is not circulating and, therefore, in contact with the coil. Consequently, the passage of Freon from liquid to gaseous condition is slower. In this circuit, therefore, there is a lower flow rate if compared with that obtained simultaneously in the other circuit, wherein the anti-freeze liquid is circulating counter-current causing a bigger exchange of refrigeration units between the two liquids. In this way, besides obtaining a quicker starting of the machine, it is obtained also the particular condition that, at the moment in which one columns starts to operate, the anti-freeze liquid contained therein is at the lowest temperature, this being necessary to allow the corresponding heat exchanger to reach the steady running temperature in the shortest possible time. After this first stage, the heat exchanger requirements in refrigeration units is lower and just in this period the anti-freeze liquid of this circuit is circulating at a slightly higher temperature. In other words, through their coupling, the cold generating unit and the dispersive one operate a self-balancing, without any intervention of the central control unit.

Chlorine-ethylene regeneration cycle

Figure 2:
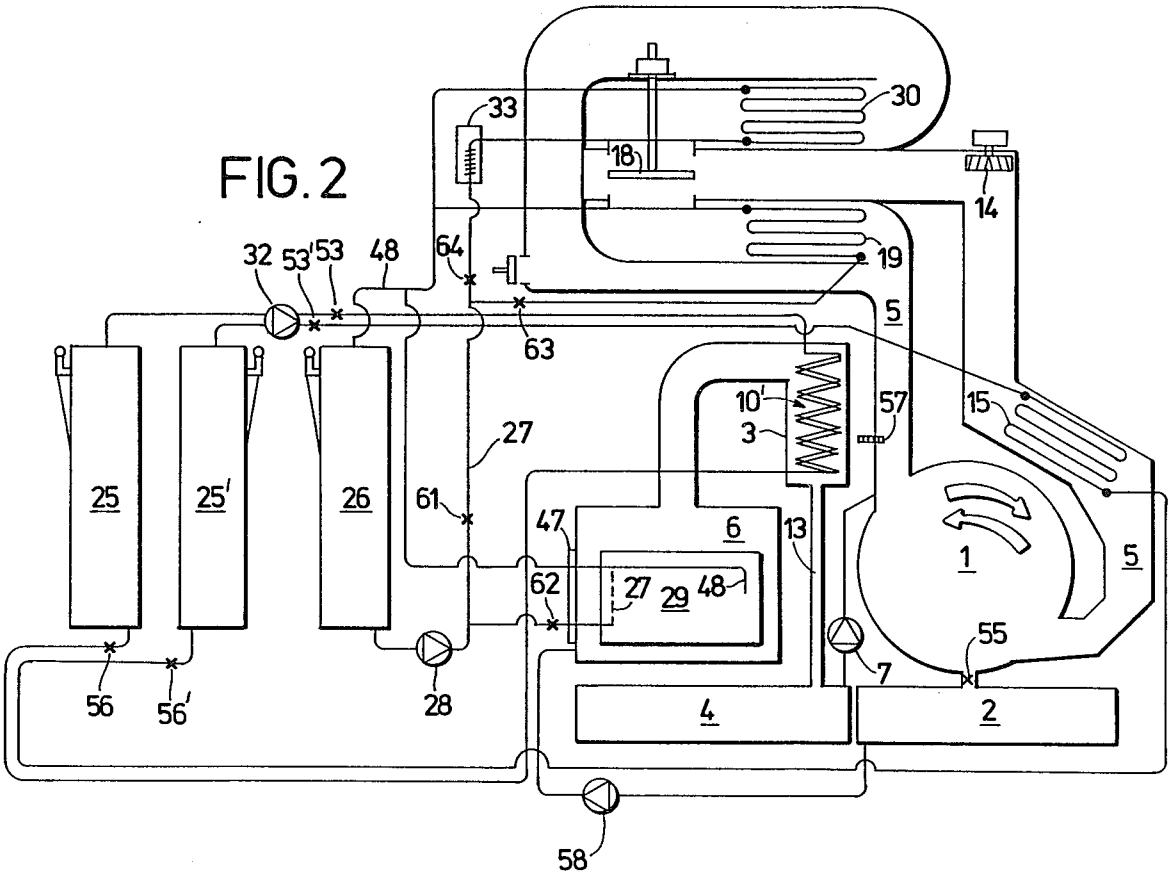
FIG. 2 is a schematical representation of the complete dry cleaning apparatus.

It is foreseen that, before performing cleaning operation, the machine carries out the chlorine-ethylene regeneration. This chlorine-ethylene dry cleaning solvent is contained inside the tank 2—FIG. 2—having been used for the previous cleaning operation—bearing in solution the material or mud removed from the dirty garments. Through the motor driven pump 58 the solvent is transferred to the tank 6 wherein it undergoes evaporation, so passing from the tank 6 to the condenser 3, inside which it returns again to the liquid condition by precipitating into the tank 4.

Figure 3:
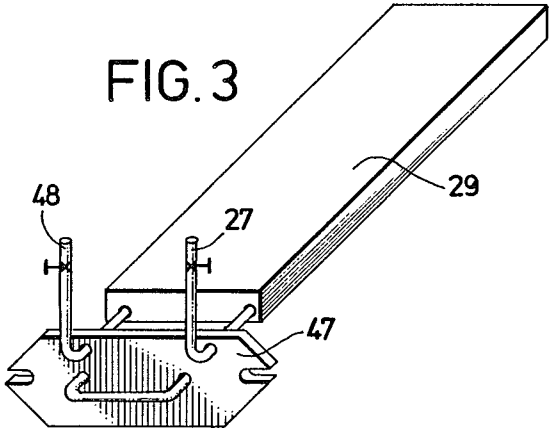
FIG. 3 is a perspective view and FIG. 3*a* a related schematical representation of the dry cleaning fluid evaporation plate of the present invention.
Figure 3A:
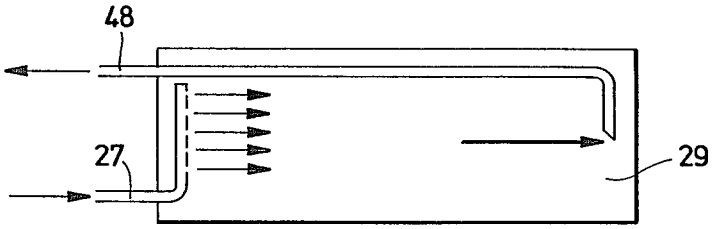

Inside the tank 6 a hollow plate 29 is provided—FIG. 3—which is overhangingly supported inside the tank 6 by the inspection door 47. This door 47 allows the removal of the hollow plate 29 from the tank 6 for better access for mud removal. As said above, the plate is hollow and inside it the heated dyathermic oil is circulating entering from the pipe 27 and exiting through the return pipe 48.

The overhanging plate leaves a free space between itself and the bottom of the tank 6 so that, when the chlorine-ethylene to be regenerated starts to be admitted to the tank 6, it meets the hollow plate 29 already heated, this one providing for its gradual evaporation. As the level of the chlorine-ethylene is increasing inside the tank 6, it keeps in direct touch with the hollow plate 29 which causes its evaporation the more quickly as its contact area with the surface of the hollow plate 29 is increasing. It is foreseen that, once the chlorine-ethylene to be regenerated is fully transferred to the tank 6 it has fully covered the hollow plate 29.

At this point, since the hollow plate 29 is still warmed by the circulation of the heated dyathermic oil, the chlorine-ethylene is continuing to evaporate and its level inside the tank 6 decreases due to its being not replaced by fresh incoming solvent.

As soon as the chlorine-ethylene has evaporates sufficiently so as to no longer be in direct contact with the hollow plate 29, the central control unit interrupts the passage of the heated dyathermic oil inside it, to start the cleaning phase. The hollow plate 29, however, is still warm for a period of time, so it continues to cause evaporation of the chlorine-ethylene standing beyond it, mixed with the muds. Such evaporation becomes slower and slower as the temperature of the hollow plate 29 decreases. Still, the plate effectively causes the muds to dessicate slowly even in their depth so as to produce a layer of non pullutant dry mud for subsequent removal.

The chlorine-ethylene regeneration phase is controlled by the central control unit according to a preset program. It starts by switching on the motor driven pump 28 which sends the dyathermic oil, heated inside the column 26, to the hollow plate 29, upon opening of the solenoid valve 62 and closing valve 61.

From the hollow plate 29 the dyathermic oil is admitted inside the return pipe 48, conveying it to the top of the column 26 through the distributing shaped plate 49, the circuit being closed in this manner. Later on, the central control unit actuates the motor driven pump 32 which sucks the cooled anti-freeze liquid from the column 25 wherein, due to its being at the lowest temperature, it quickly cools the pipe coil 10' through which the anti-freeze liquid is flowing before entering into the motor driven pump 32 which forces it inside the top of the column 25, so closing the circuit. The central control unit controls this operation by opening the solenoid valves 56 and 53 and by closing the 56' and 53' ones.

The environment is so prepared, and the central control unit actuates the motor driven pump 58 which gradually transfers the chlorine-ethylene to be regenerated from the tank 2 into the tank 6. In the tank 6 the chlorine-ethylene evaporates then condensating again into the condenser 3 and reaching the tank 4. At the end of this phase, which is carried out as described above, the central control unit closes the solenoid valve 62 and opens the valve 61 so to start the cleaning cycle.

Cleaning cycle

This cycle is started by the central control unit by actuating the barrel 1 and transferring the chlorine-ethylene to it, through the motor driven pump 7 which sucks it from the tank 4. Immediately after the electric fan 14 is actuated, which sucks the air from the barrel 1 through the recycling duct 5 conveying it at first through the radiator 15 then through a second radiator 19 before coming again to the barrel 1.

At the end of the chlorine-ethylene regeneration phase the central control unit has operated closing the solenoid valve 62 and opening the valves 61 and 63 so allowing in this way the heated dyathermic oil to circulate through the radiator 19. Simultaneously, it has closed the solenoid valves 56 and 53 and opened the valves 56' and 53', so causing the anti-freeze liquid, coming this time from the column 25', to circulate through the radiator 15.

In this way the chlorine-ethylene vapours rising through the recycling duct 5 meet the heat exchanger (radiator) 15 which is already cold and passing through it they condense and the condensate fall down, so returning through the duct to the barrel 1.

The air, which is cooled, continues to flow into the recycling duct 5 and passes through the radiator 19 which is already heated again before coming back to the barrel 1.

This starting of the cleaning cycle is performed very quickly because the dyathermic oil reaching the radiator 19 has already reached its steady temperature and, by its circulation, it quickly warms the abovesaid radiator 19. The radiator 15 reaches the steady temperature just as quickly, because the motor driven pump 32 is now sucking the anti-freeze liquid from the column 25' wherein the anti-freeze liquid is standing at the lowest temperature, so in an extremely good condition to supply those refrigeration units in excess which are needed to quickly cool the radiator 15.

As soon as the cleaning cycle is started, the central control unit is in a position to adjust continuation of this cycle by means of the signals the thermostat 57 is transmitting, from measuring the temperature of the air before its return to the barrel 1. Both the temperature of the circulating air and the quantity of chlorine-ethylene to be introduced into the barrel 1 are programmed at the start of the cycle by the operator, according to the kind and quantity of garments to be cleaned.

Should it be necessary to increase the temperature of the circulating air, the central control unit operates by first opening the solenoid valve 64, then throttling the air through the flow deflecting valve 18 so that a part of the air is continuing to pass through the radiator 19 and the remainder through the radiator 30. In this way, since the circulating air is constant but the irradiating surface is increased there is an increase in temperature which may be adjusted by the central control unit by changing the position of the flow deflecting valve 18.

Drying cycle

Once the cleaning cycle is over, the dyring cycle starts. The central control unit operates by opening of the solenoid valve 55 so discharging from the barrel 1 the chlorine-ethylene which descends to the tank 2. Then the central control unit switches on the resistor inside the pipe 33, this resistor causing a further heating of the dyathermic oil, already heated, which circulates therein before reaching the radiator 30. Thus, there are two radiators at different temperatures: the radiator 19 having a lower temperature corresponding to that of the dyathermic oil coming out from the column 26, the radiator 30 at a high temperature since the heated dyathermic oil coming from the column 26 is further heated by its passing through the pipe 33 in contact with the resistor therein.

The central control unit adjusts the temperature of the drying air through the flow deflecting valve 18, allowing the passage of a bigger quantity of air through the radiator 30 when the temperature must be increased or acting viceversa when it has to be reduced. Almost at the end of the drying cycle the garments have to be treated with air progressively less heated, so the central control unit at first disconnects the resistor inside the duct 33, closing then the solenoid valve 64 so interrupting heating the radiator 30; at least it closes also the solenoid valve 61 and opens the valve 62, should a new cycle have to be initiated, while both the solenoid valves 61 and the motor driven pump 28 are closed in case the operating cycle has to be stopped. Immediately after it stops the refrigerating compressor unit 22 and finally the motor driven pump 32, while closing the solenoid valves 53' and 56'.

After having stopped the barrel 1 and the electric fan 14, the attendant may take off the cleaned garments, which are at the ambient temperature and completely deodorized, the machine being ready for the chlorine-ethylene regeneration phase in case a further cleaning has to be done, or being set to perform a new cycle in case one intends to stop working temporarily.

We claim:

1. An apparatus for dry cleaning clothes and fabrics in a barrel or the like with a dry cleaning solvent and circulating air, said apparatus allowing efficient operation during clothes cleaning, clothes drying and solvent regeneration phases, comprising:

a heat and cold generating unit for heating and cooling a heat exchange medium;

a heat exchange medium circuit means for circulating heated heat exchange medium for heat transfer to a heating liquid and circulating cooled heat exchange medium for heat transfer from a cooling liquid;

a heating liquid circuit means including an evaporator, two radiators and a resistor heater, said heating liquid circuit means circulating heating liquid through said evaporator so as to cause evaporation of said dry cleaning solvent during said solvent regeneration phase and said heating liquid circuit means circulating therein liquid through a split circuit independently to said two radiators during said cleaning and drying phases, said resistor heater being provided in said split circuit upstream of one of said radiators for further heating of said heating liquid;

throttling means for controlling air flow through said two radiators so as to allow careful adjustment of the temperature of air circulating through said clothes barrel during both cleaning and drying phases; and a cooling liquid circuit means including a condenser and a heat exchanger, said cooling liquid circuit means circulating cooling liquid through said condensor for condensing said dry cleaning solvent vapors from said evaporator during said solvent regeneration phase and said cooling liquid circuit means circulating cooling liquid through said heat exchanger so as to condense dry cleaning solvent vapors from air circulating through said clothes barrel during said cleaning phase.

2. The apparatus of claim 1, further comprising:

a compressor in said heat and cold generating unit for compressing and heating said heat exchange medium;

a heating column having a bottom portion filled with heating liquid and a top portion including a heating liquid distributor, said heating column further including a heating coil through which said heat exchange medium is circulated from said compressor so as to transfer heat to said heating liquid, said heating coil extending above said bottom portion of said heating column and being formed by a finned tube;

said heating liquid circuit means also including means for returning said heating liquid from said evaporator, two radiators and resistor heater to said top portion of said heating column wherein said heating liquid is passed over said distributor that distributes said heating liquid over said finned tube so as to flow down and along said tube in a direction counter to direction of circulation of said heat exchange medium in said tube;

an expansion unit in said heat exchange medium circuit means, said heat exchange medium circulating from said heating column through said expansion unit which expands and cools said heat exchange medium;

two cooling columns, each column including a bottom portion filled with cooling liquid and a top portion including a cooling liquid distributor, each of said cooling columns further including a cooling coil, said heat exchange medium circuit means splitting between said expansion unit and cooling columns so as to provide circulation of cooled heat exchange medium from said expansion unit through each of said cooling coils;

said cooling liquid circuit means also including means for returning cooling liquid from said condenser and heat exchanger to said top portion of each of said cooling columns wherein said cooling liquid is passed over said distributor that distributes cooling liquid over said cooling coils and thereby transfer heat from said cooling liquid to said heat exchange medium; and means for returning said heat exchange medium from said cooling columns to said compressor.

3. The apparatus of claim 2, further comprising means for circulating cooling liquid through said cooling circuit and only one of said cooling columns so that cooling liquid remains stagnate in the bottom portion of the other of said cooling columns thereby allowing said stagnate cooling liquid to be brought to as low a temperature as possible prior to use.

4. The apparatus of claim 1, wherein said evaporator includes an evaporator tank and a hollow heating plate heated by circulating heating liquid during said regeneration phase, said hollow heating plate being spaced from a bottom wall of said tank so that contact between said heating plate and said solvent and, therefore, the rate of evaporation increases with the presence of increasing amounts of solvent; said plate remaining sufficiently hot during cleaning and drying phases to evaporate substantially all of said solvent from mud remaining in the bottom of the tank following said regeneration phase.

5. The apparatus of claim 2, wherein said cooling liquid circuit comprises two subcircuits, in a first of said subcircuits, a first of said two cooling columns provides cooled cooling liquid for circulating through said condensor for condensing dry cleaning solvent from the evaporator during said solvent regeneration phase and in a second of said subcircuits a second of said two cooling columns provides cooled cooling liquid for circulating through said heat exchanger for condensing dry cleaning solvent from air circulating through said clothes barrel.

6. An apparatus for dry cleaning clothes and fabrics in a barrel or the like with a dry cleaning solvent and circulating air, said apparatus allowing efficient operation during clothes cleaning, clothes drying and solvent regeneration phases, comprising:

a heat and cold generating unit for heating and cooling a heat exchange medium;

a heat exchange medium circuit means for circulating heated heat exchange medium for heat transfer to a heating liquid and circulating cooled heat exchange medium for heat transfer from a cooling liquid;

a heating liquid circuit means including an evaporator, at least one radiator and a resistor heater, said heating liquid circuit means circulating heating liquid through said evaporator so as to cause evaporation of said dry cleaning solvent during said solvent regeneration phase and said heating liquid circuit means circulating heating liquid through said at least one radiator during said cleaning and drying phases, said resistor heater being provided in said heating circuit liquid means upstream of said at least one radiator for further heating of said heating liquid so as to allow careful adjustment of the cleaning temperature and thereby providing for faster clothes drying during said drying phase; and a cooling liquid circuit means including a condenser and a heat exchanger, said cooling liquid circuit means circulating cooling liquid through said condenser for condensing said dry cleaning solvent vapors from said evaporator during said solvent regeneration phase and said cooling liquid circuit means circulating cooling liquid through said heat exchanger so as to condense dry cleaning solvent vapors from said air circulating through said clothes barrel during said cleaning phase.

* * * * *